United States Patent [19]

Hales, Sr. et al.

[11] Patent Number: 4,996,740

[45] Date of Patent: Mar. 5, 1991

[54] DOOR CLOSER ADAPTER/REPLACEMENT ASSEMBLY

[75] Inventors: Robert N. Hales, Sr.; Robert N. Hales, Jr.; Erwin J. Hales, III, all of Durham, N.C.

[73] Assignee: National Door Controls, Durham, N.C.

[21] Appl. No.: 396,856

[22] Filed: Aug. 22, 1989

[51] Int. Cl.[5] ..... E05D 7/08

[52] U.S. Cl. ..... 16/378; 16/273; 16/DIG. 43

[58] Field of Search ..... 16/378, 387, 2, 275, 16/273, DIG. 43

[56] References Cited

U.S. PATENT DOCUMENTS

| | | | |
|---|---|---|---|
| 1,832,699 | 11/1931 | Garrison | 16/55 |
| 3,106,743 | 10/1963 | Ellis et al. | 16/55 |
| 3,117,827 | 1/1964 | Cecala | 16/275 |
| 3,145,414 | 8/1964 | Martin | 16/378 |
| 3,662,493 | 5/1972 | Foltz | 16/275 |

OTHER PUBLICATIONS

"'PH' Series Heavy Duty Exterior and Interior Floor Closure for Physically Handicapped Access," Rirson–Fire Mark undated PPG Industries May, 1984 product catalog for Architectural Metals, pp. C–3 and C–4.

*Primary Examiner*—Richard K. Seidel
*Assistant Examiner*—James Minen
*Attorney, Agent, or Firm*—Richard E. Jenkins

[57] ABSTRACT

A door closer adapter/replacement assembly for converting a doorway equipped with an interiorly mounted door closer unit for usage with an exteriorly mounted door closer unit. The assembly comprises (a) a bushing positionable on an exteriorly protruding spindle of the interiorly mounted door closer unit, and (b) an arm including a tongue affixable to a door fitting the doorway, and a structural portion defining a cavity which is matable with the bushing. The bushing and the structural portion of the arm defining the cavity are constructed and arranged such that the arm is free-spinning on the bushing. The assembly is employable on spindles of both header (overhead) mounted and floor mounted door closer units, and obviates the need for disassembly of the overhead structure or threshold of the doorway, so that the concealed door closer can remain in place while the door is adapted to use with an exteriorly mounted door closer unit.

9 Claims, 4 Drawing Sheets

DOOR CLOSER ADAPTER/REPLACEMENT ASSEMBLY

BACKGROUND OF THE INVENTION

1. Field of the Invention

This invention relates to a door closer adapter/replacement assembly having utility for converting a doorway equipped with an interiorly mounted door closer unit to usage with an exteriorly mounted door closer unit, wherein the interiorly mounted door closer unit includes an exteriorly protruding spindle having fixedly mounted thereon an arm secured to a door in the doorway.

2. Description of the Related Art

Door closers are employed in a wide variety of buildings including stores, churches, schools, hospitals, and other public buildings with heavy doorway traffic. In such applications, door closers facilitate ingress and egress to building structures by relieving entering and leaving persons of the need to shut doors behind them. Further, by returning the doors on which they are employed to a closed position, such devices aid in conserving energy consumed by HVAC systems which are used to maintain a selected interior environment in the building which is different from the ambient exterior environment.

Door closers are generally characterized as being of two main types. Overhead door closers typically are concealed in the header structure of a doorway above the door. Examples of this type of door closer include the Jackson Model 20-330, commercially available from Jackson Exit Device Corporation (Los Angeles, CA) and described in U.S. Pat. No. 3,246,362. Floor door closers are concealed in the flooring or threshold beneath a door and may be of various configurations, including center pivot and offset door closer structures. Examples include the PH 27 Series offset hung door closers and the PH 28 Series center hung floor closers commercially available from Rixson-Firemark Division of Conrac Corporation (Franklin Park, Ill.).

Regardless of whether the door closer is an overhead closer type or a floor closer type, the closer unit generally comprises a casing containing the mechanical and hydraulic components which effect return of the door to the desired closed position after it is displaced from such position. The casing is concealed in the header or threshold of the doorway, depending on the specific type of closer employed, and has a spindle protruding from the casing. The spindle typically has a square or generally rectangular cross-section. The spindle mounts an arm with an opening or slot of corresponding shape to the spindle, and mating therewith. The arm in turn is mechanically secured to the door. For such purpose, the arm may be edge mounted on an appropriate edge surface of the door, or it may be positioned in a recessed channel in the edge portion of the door and mechanically secured to the door, such as by means of mechanical fasteners.

A major problem with door closers of both major types is that their service life is typically very short relative to the useful life of the building structure in which they are employed. For example, overhead door closers may have a useful service life on the order of 3 million "openings" of the door on which they are employed. In high traffic locations, this service life may only be on the order of about 3-5 years.

Floor mounted door closers are generally more durably constructed and of heavier duty character than overhead door closers, but their service life in high traffic applications may only be on the order of 10-15 years.

At the end of its service life, the concealed character of the door closer, which has been a significant advantage during its service life for reasons of aesthetics, becomes a severe disadvantage since the door closer unit is not readily accessible for removal and replacement.

Specifically, replacement of overhead door closers may require disassembly of the header structure of a doorway, with removal of moldings, tearing out of sheetrock, etc., and subsequent repair of such damage.

In the case of floor mounted door closers, the threshold likewise must be torn up to retrieve the floor closer unit for replacement, and again repair and reconstruction of the threshold is necessary. Floor closers frequently are employed in concrete floorings and the demolition of the threshold and subsequent need for its repair are particularly disadvantageous in such instances.

In contrast to concealed door closers, exteriorly mounted door closers are readily removed, replaced, and repaired. Being exteriorly mounted, such door closer units are of course visible, but, particularly in recent years, such units have been designed to possess an aesthetic appearance and a compact structure.

In view of the tedious, time-consuming, and expensive character of replacing concealed door closers, it is an object of the present invention to provide a door closer adapter/replacement assembly having utility for converting a doorway equipped with an interiorly mounted door closer unit to usage with an exteriorly mounted door closer unit, which does not require any demolition or disassembly of headers or thresholds in which such concealed door closers are deployed.

Other objects and advantages of the present invention will be more fully apparent from the ensuing disclosure and appended claims.

SUMMARY OF THE INVENTION

The present invention relates to a door closer adapter/replacement assembly having utility for converting a doorway equipped with an interiorly mounted (concealed) door closer unit to usage with an exteriorly mounted door closer unit, in which the interiorly mounted door closer includes an exteriorly protruding spindle having fixedly mounted thereon an arm secured to a door in the doorway.

The door closer adapter/replacement assembly comprises:

(a) a bushing positionable on said exteriorly protruding spindle; and (b) an arm with (i) a tongue affixable to a door fitting the doorway, and (ii) a structural portion defining a cavity matable with the bushing, and with the bushing and the structural portion of the arm being constructed and arranged such that the arm is free-spinning on the bushing;

whereby when (i) a door secured to an arm fixedly mounted on the exteriorly protruding spindle is demounted from the spindle, (2) the bushing thereafter is positioned on the spindle, and (3) the arm (b) is affixed to a door (which may be the former door, or a new replacement door) fitting the doorway, with the arm (b) free-spinningly mounted on the bushing by mating the bushing with the cavity in the arm (b), the door then becomes operatively attachable to an exteriorly mounted door closer unit. In another aspect, the present invention relates to a method of converting a doorway equipped with an interiorly mounted door closer unit to usage with an exteriorly mounted door closer unit, in which the interiorly mounted door closer unit includes an exteriorly protruding spindle having fixedly mounted thereon an arm secured to a door in the doorway. Such method includes the provision of a door closer adapter/replacement assembly as broadly described above, followed by the steps of:

demounting the door secured to the arm which is fixedly mounted on the exteriorly protruding spindle;

affixing the tongue of the arm (b) to a door fitting the doorway, which may be the door formerly attached to the arm fixedly mounted on the spindle arm (in which case the fixedly mounted arm is removed from the door), or alternatively a new door;

positioning the bushing on the spindle;

mounting the door in the doorway so that the cavity of the structural portion (b) (ii) mates with the bushing, such that the door is free-spinning on the bushing; and engaging the door with an exteriorly mounted door closer unit.

Other aspects and features of the present invention will be more fully apparent from the ensuing disclosure and appended claims.

DETAILED DESCRIPTION OF THE INVENTION, AND PREFERRED EMBODIMENTS THEREOF

Figure 1:
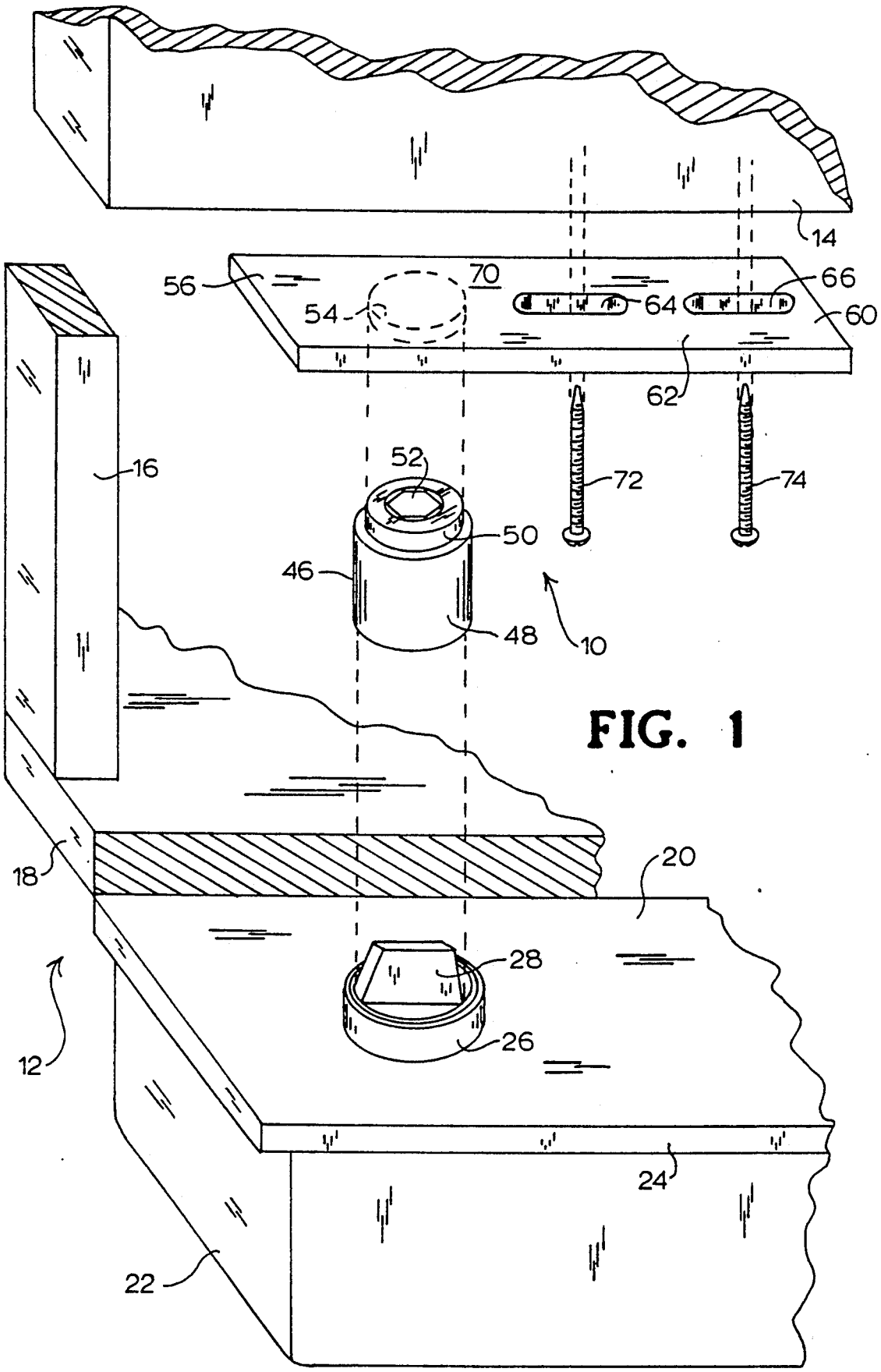
FIG. 1 is a perspective view of a floor-mounted door closer unit positioned in a doorway, showing, in exploded view, the components of a door closer adapter/replacement assembly according to the present invention for converting the doorway to usage with an exteriorly mounted door closer unit.

Referring now to the drawings, FIG. 1 shows an exploded perspective view of a door closer adapter/replacement assembly 10 according to one embodiment of the present invention. The adapter/replacement assembly is shown disposed in a doorway 12 comprising door 14, door jam 16, and threshold flooring 18. Beneath the threshold flooring is a concealed (interiorly mounted) door closure unit 20 comprising a casing 22 and a top floor mount plate 24, from which upwardly extends a collar 26 from which further upwardly extends a spindle 28.

The flooring 18 may be of any suitable type, including wood flooring or subflooring, concrete, or other suitable material of construction. The flooring is overlayed on the floor mounting plate 24 of the door closer unit 20, so that such unit is fully concealed except for vertically upwardly extending spindle 28.

Figure 2:
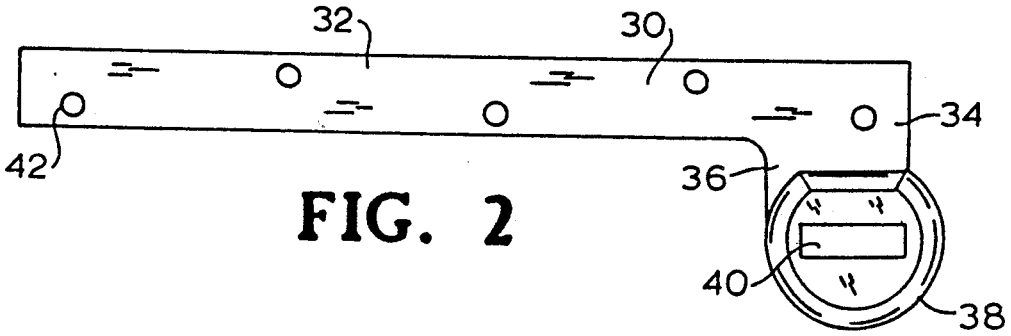
FIG. 2 PRIOR ART
FIG. 2 is a prior art arm fixedly mounting to the spindle of the floor-mounted floor closer shown in FIG. 1, in top plan view.
Figure 3:
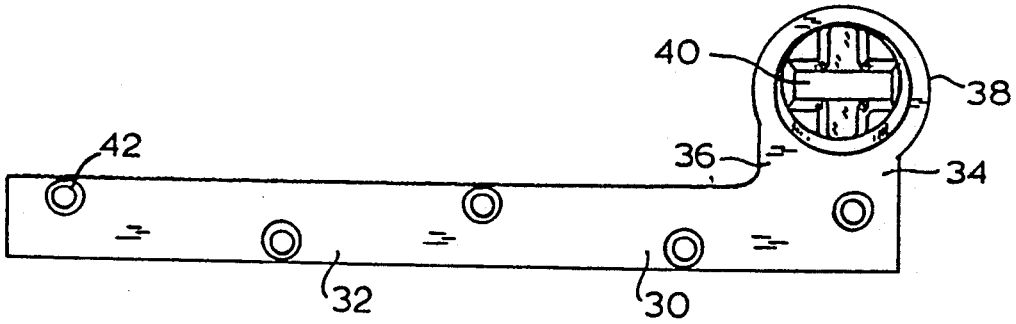
FIG. 3 PRIOR ART
FIG. 3 is a bottom plan view of the prior art arm of FIG. 2.

In the original installation of the floor mounted door closer unit 20, the spindle 28 has fixedly mounted thereon an arm which is secured to a door in the doorway. Such arm may be of a type as shown in FIGS. 2 and 3. FIG. 2 shows a top plan view, and FIG. 3 the corresponding bottom plan view, of the arm 30. This arm comprises a main planar bar portion 32 of elongate character. At one end 34 of the bar is a lateral extension 36 to which a cup member 38 is attached. Cup member 36 has a slot 40 therein, which mates with the spindle 28 of the FIG. 1 door closer.

The main bar portion 32 of arm 30 is provided with a plurality of longitudinally spaced-apart holes 42 for securing the arm to the bottom of an associated door by means of mechanical fasteners. Thus, with the arm 30 mounted on the bottom edge surface of a door, the cup member 38 is positioned so that the slot 40 therein is engaged by spindle 28. Subsequently, any displacement of the door from the normal closed position results in the door closer unit 20 returning the door to the closed position. The door is offset pivoted with such arm, and the arm 30 and spindle 28 form a conjoint assembly which thereafter moves (rotates) as a unit, relative to the pivot point.

When the FIG. 1 door closer unit has reached the end of its useful service life and no longer is operable, the adapter/replacement assembly 10 shown in FIG. 1 may be employed to convert the doorway equipped with the interiorly mounted door closer unit to usage with an exteriorly mounted door closer unit (not shown).

Specifically, the door closer adapter/replacement assembly in this illustrative embodiment comprises a bushing member 46 which is positionable on the exteriorly protruding spindle 28. The bushing shown in FIG. 1 comprises a lower main body portion 48 which fixedly overfits the spindle 28, and a free-spinning bearing-mounted upper portion 50. The bearing-mounted upper portion 50 is secured to the lower main body portion 48 by means of the mechanical fastener 52, which nonetheless allows free spinning of the upper portion relative to the lower main body portion.

The free-spinning bearing-mounted upper portion 52 is matingly engageable with a correspondingly configured cavity 54 in an end portion 56 of arm 60. The arm 60 comprises an end portion 56, and a tongue portion 62 which is provided with openings 64 and 66 extending therethrough. The top main surface 70 of the arm 60 is mated abuttingly with the lower edge surface of the door 14. Alternatively, the arm 60 could be disposed in a recessed channel in such door.

The mechanical fasteners 72 and 74 extend through tongue openings 64 and 66 respectively and into the body of the door 14, to mechanically affix the arm 60 to the door.

By such arrangement, even though the floor mounted door closer unit 20 is inoperative for its intended purpose, in that the spindle 28 is not displaceable so as to return to the position associated with a closed door, the adapter/replacement assembly permits the door to be mounted thereon so that the door thereafter accommodates the installation of an exteriorly mounted door closer. Thus, the door is joined to the arm 60. The cavity 54 in the underside of the arm 60 receives the free-spinning bearing-mounted upper portion 50 of the bushing 46, with the lower main body portion 48 of the bushing being fixedly reposed on spindle 28. As a result, the door is freely pivotable on the adapter/replacement assembly, and once an exteriorly mounted door closer is attached to the door, the door functions in accordance with the normal mode of operation of the exteriorly mounted unit.

Figure 4:
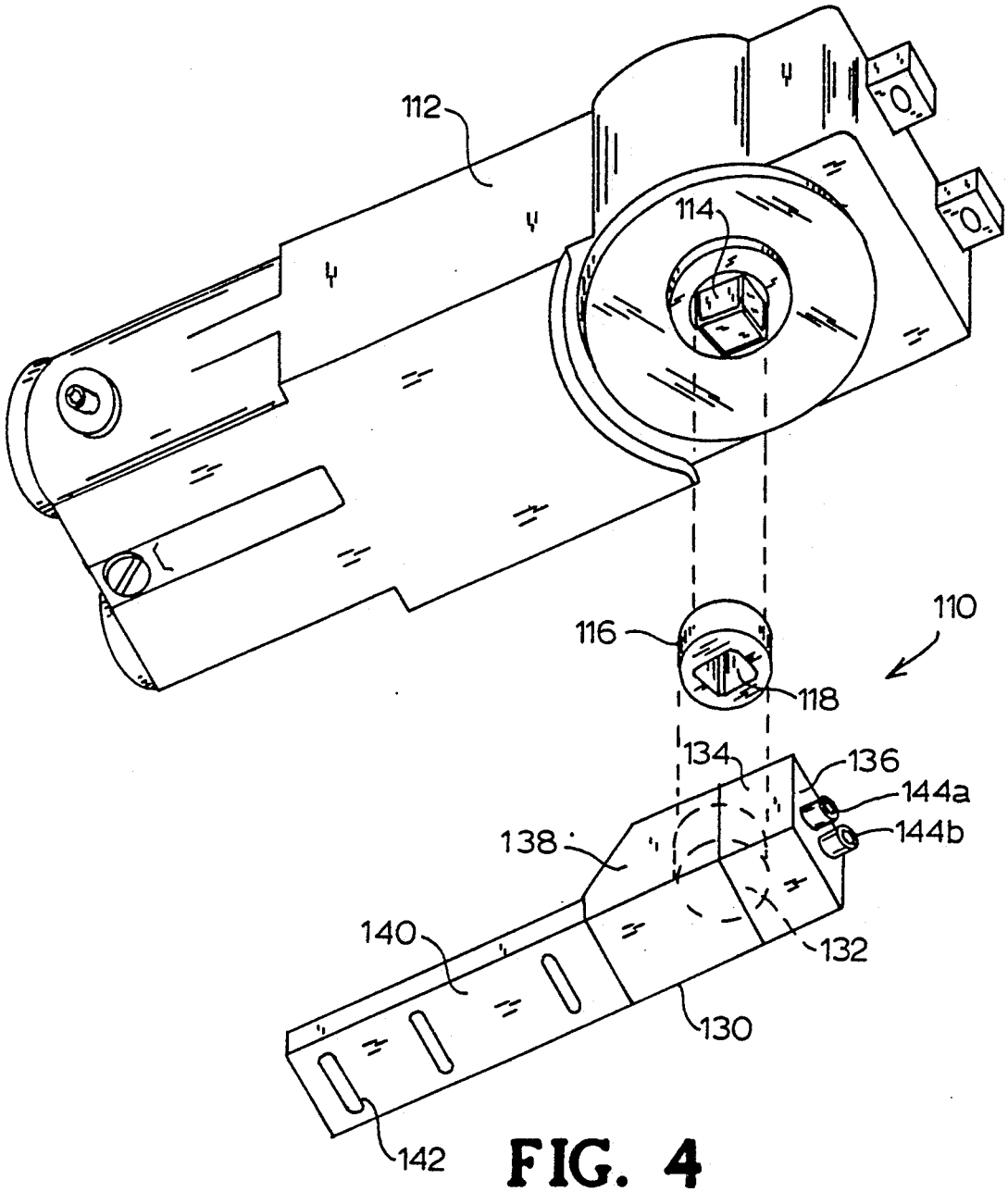
FIG. 4 is an exploded perspective view of an overhead door closer and an appertaining door closer adapter/replacement assembly according to another embodiment of the present invention.

FIG. 4 is an exploded perspective view of a door closer adapter/replacement assembly 110 for converting a doorway furnished with an overhead concealed door closer 112 to usage with an exteriorly mounted door closer unit (not shown).

As illustrated, the overhead concealed door closer unit 112 has a spindle 114 with a square cross-section.

In this embodiment, the adapter/replacement assembly comprises a bushing 116 which is positionable on the square spindle 114. The bushing features a central opening 118 of square cross-section, for mating of the spindle 114 therewith. The exterior surface of the bushing 116 is cylindrical.

The bushing 116 matably engages the arm 130, which is provided an interior cavity 132 for receiving the exterior cylindrical surface of the bushing.

The cavity 132 of arm 130 is formed in a head portion 134 of the arm, which is in turn composed of two distinct parts. The first head member 136 forms a half cavity and matably engages the second head member 138 of the arm forming the other half cavity.

Second head portion 138 is integrally formed with the elongate tongue 140 of the arm. Holes 142 are provided in the tongue, for affixation of the arm to an edge portion of a door with suitable mechanical fasteners, such as bolts, screws, nails, or the like. The first head member 136 is joined to the second head member 138 by means of screw 144, which passes through holes in the respective head members. Such holes are threaded to engage the screw 144.

In use, the bushing 116 is positioned on the spindle 114 of the overhead door closer. A door, to the upper edge portion of which the arm 130 has been secured by means of mechanical fasteners such as screws, bolts, nails, or the like, then is brought into position in the doorway so that the cavity 132 in the head of the arm receives the cylindrical outer surface of the bushing 116. By such arrangement, the arm mounted on the door is adapted to freely pivot on the bushing, to accommodate the joining of the door to an exteriorly mounted door closer unit.

Figure 5:
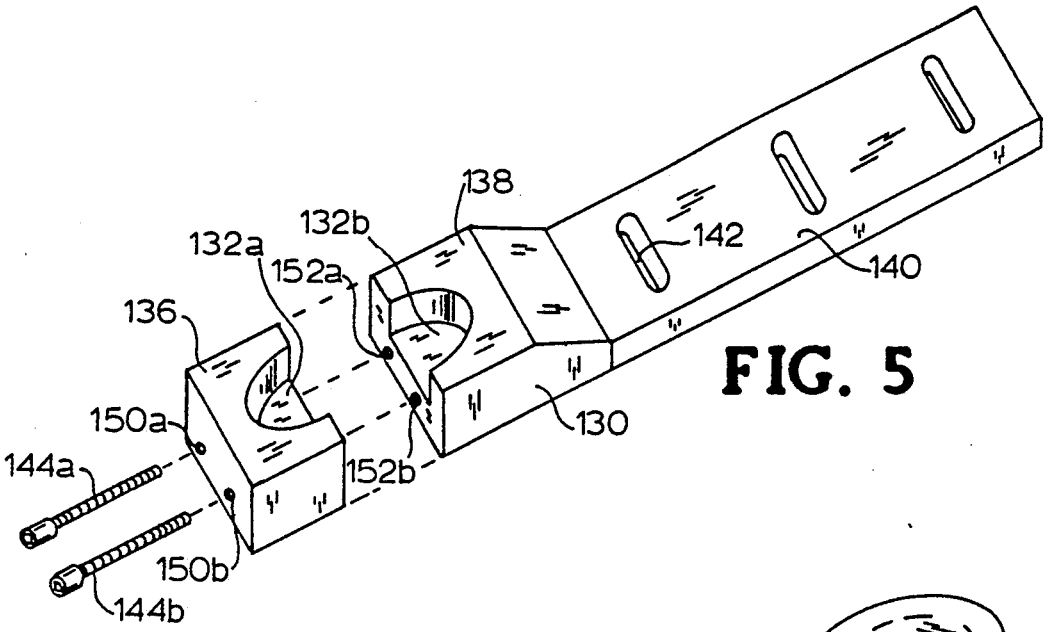
FIG. 5 is a perspective exploded view of the arm employed in the FIG. 4 door closer adapter/replacement assembly.
Figure 6:
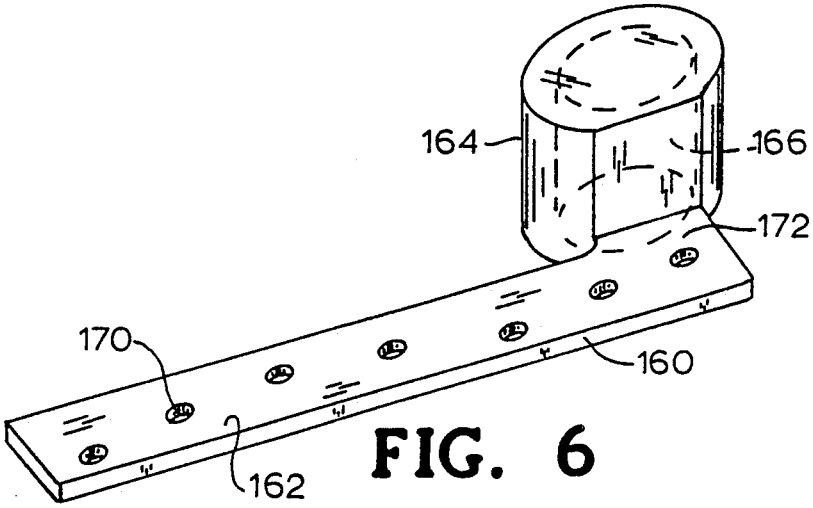
FIG. 6 is a perspective view of another arm according to a further embodiment of the present invention, as may be usefully employed with the bearing-type bushing shown in FIGS. 1 and 4.

FIG. 5 is an exploded perspective view of the arm 130 shown in FIG. 4, wherein all parts and features in FIG. 6 are numbered correspondingly with respect to FIG. 4.

As shown, the arm 130 is constructed from two main pieces. The tongue 140 is integrally formed with the second head member 138. The second head member is provided with a semi-cylindrical depression **132*b* therein. The first head member 136 correspondingly is formed with a semi-cylindrical depression 132*a* therein. Upon mating of the respective first and second head members, and joining of these respective pieces to one another by means of the screw 144 passing through the respective threaded passages 150 and 152, the arm structure is produced with a cavity 132** formed by the constituent cavity half sections in the respective head members.

It will be recognized that the bushing in the adapter/replacement assembly may be varied widely in its construction, and may include a single bushing element, as well as multiple matable bushing elements, the choice of a specific construction being readily determinable in any specific application by one of ordinary skill in the art.

Figure 7:
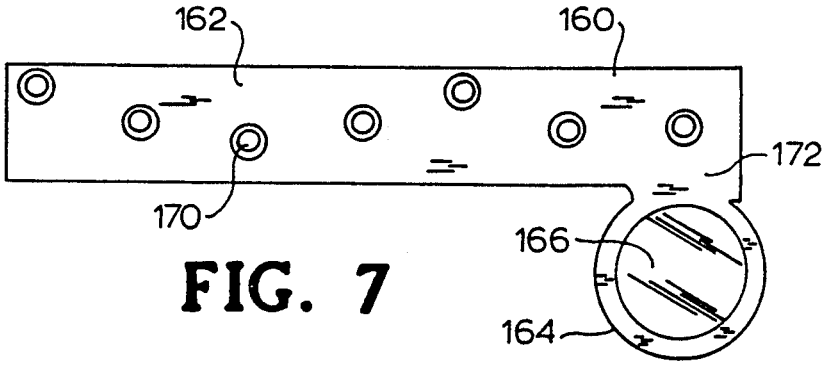
FIG. 7 is a bottom plan view of the arm shown in FIG. 6.

FIG. 6 is a perspective view, and FIG. 7 a corresponding bottom plan view of an arm 160 according to a still further embodiment of the invention. The arm 160 comprises an elongate bar 162 having longitudinally spaced-apart openings 170 therein for attachment of the bar, or tongue, of the arm to the receiving surface of a door, i.e., a top or bottom edge portion of the door. Attachment of the arm to the door may be effected with the use of mechanical fasteners, such as screws, bolts, nails, or the like.

At one end 172 of arm 160, a cup member 164 is mechanically joined to the elongate bar. The cylindrical cup member 164 may be integrally formed, e.g., by casting or molding, with the elongate bar 162. Generally, however, it is satisfactory to form the cup member and elongate bar as separate elements and then to braze or weld the cup member to the elongate bar, to form the arm construction shown. The cup member 164 has a cylindrical cavity 166 therein, with the inlet or open end of the cavity being in substantially the same plane as the planar elongate bar 162.

The arm shown in FIG. 6 and 7 may be utilized with a suitable bushing which is placed over the spindle of a concealed door closer, with the cup member 164 subsequently being mounted over such bushing, so that the arm 160 is freely rotatable on the bushing mounted on the spindle.

Although the invention has been described with reference to specific aspects and illustrative embodiments thereof, it will be appreciated that numerous variations, modifications and alternative embodiments exist, and accordingly the scope of the invention is to broadly construed as including such variations, modifications, and embodiments.

What is claimed is:

1. In combination with an interiorly mounted door closer unit having an exteriorly protruding spindle, a door closer adapter/replacement assembly for converting said interiorly mounted door closer unit to usage with an exteriorly mounted door closer unit and comprising:

(a) a bushing positionable on said exteriorly protruding spindle; and (b) an arm with (i) a tongue affixable to a door fitting said doorway, and (ii) a structural portion defining a cavity matable with said bushing, and with said bushing and said structural portion of said arm being constructed and arranged such that said arm is free-spinning on said bushing;

whereby when (1) a door secured to an arm fixedly mounted on said exteriorly protruding spindle is demounted from said spindle, (2) said bushing is positioned on said spindle, and (3) said arm (b) is affixed to a door fitting said doorway and is free-spinningly mounted on said bushing by mating of the bushing with the cavity in said structural portion (ii) of said arm (b), the said door then is operatively attachable to an exteriorly mounted door closer unit.

2. A door closer adapter/replacement assembly according to claim 1, wherein the bushing comprises a lower main body portion for fixedly overfitting the exteriorly protruding spindle and a free spinning bearing-mounted upper portion mating engageable with said cavity, such that the arm (b) and said bearing mounted portion of the bushing are jointly free-spinnable relative to the lower main body portion of said bushing.

3. A door closer adapter/replacement assembly according to claim 1, wherein the bushing is of single piece construction, having a cylindrical shape, with a central opening sized and configured for close fit mounting on said exteriorly protruding spindle, such that said bushing is non-rotatably secured to said spindle.

4. A door closer adapter/replacement assembly according to claim 3, wherein said central opening is of square cross-section.

5. A door closer adapter/replacement assembly according to claim 1, wherein said arm (b) comprises an elongate bar tongue portion having mounting holes therein for mechanically fastening affixation of the arm to a said door.

6. A door closer adapter/replacement assembly according to claim 5, wherein said structural portion (b) (ii) comprises a generally cylindrical cup member having an interior volume constituting said cavity.

7. A door closer adapter/replacement assembly according to claim 6, wherein said elongate bar is generally planar and said cup member has an open end communicating with said cavity, and said open end is substantially in the plane of said elongate bar.

8. A door closer adapter/replacement assembly according to claim 7, wherein the cup member is laterally joined to an end part of said tongue portion.

9. A method for converting a doorway equipped with an interiorly mounted door closer unit to usage with an exteriorly mounted door closer unit, wherein the interiorly mounted door closer unit includes an exteriorly protruding spindle having fixedly mounted thereon an arm secured to a door in the doorway, said method comprising:

(A) providing a door closer adapter/replacement assembly comprising:
  (a) a bushing positionable on said exteriorly protruding spindle; and
  (b) an arm with (i) a tongue affixable to a door fitting the doorway, and (ii) a structural portion defining a cavity matable with the bushing, and with the bushing and the structural portion of the arm being constructed and arranged such that the arm is free-spinning on the bushing when the bushing is received in the cavity;

(B) demounting from the exteriorly protruding spindle the door secured to the arm fixedly mounted on the spindle;

(C) positioning the bushing on the spindle;

(D) affixing the arm (b) to a door fitting the doorway; and (E) mating the bushing with the cavity of the arm (b) so that the arm is free-spinningly mounted on the bushing.

* * * * *